United States Patent [19]

Shimada

[11] 4,248,533

[45] Feb. 3, 1981

[54] DISTORTED TEXTURE DETECTING METHOD

[75] Inventor: Ryoichi Shimada, Sabae, Japan

[73] Assignee: Seiren Denshi Kabushiki Kaisha, Fukui, Japan

[21] Appl. No.: 935,637

[22] Filed: Aug. 21, 1978

[30] Foreign Application Priority Data

Dec. 21, 1977 [JP] Japan ..... 52-152864

[51] Int. Cl.[3] ..... G01N 21/89

[52] U.S. Cl. ..... 356/238; 250/237 G; 250/572; 250/578; 356/430

[58] Field of Search ..... 356/238, 374, 430; 250/237 G, 572, 578

[56] References Cited

U.S. PATENT DOCUMENTS

| | | | |
|---|---|---|---|
| 2,355,465 | 8/1944 | Oberkirk | 250/572 X |
| 2,886,718 | 5/1959 | Shepherd et al. | 250/237 G |
| 3,394,248 | 7/1968 | Ogden | 250/237 G |
| 3,517,204 | 6/1970 | Mahlo et al. | 356/238 |

*Primary Examiner*—John K. Corbin
*Assistant Examiner*—Bruce Y. Arnold
*Attorney, Agent, or Firm*—Fleit & Jacobson

[57] ABSTRACT

The invention relates to a method for detecting continuously the direction of the weft threads in a moving woven material. A plurality of unit slits (at least three), hereinafter referred to as a "divided slit arrangement," is provided, the plurality of unit slits having a pitch substantially the same as that of the weft threads. The divided slit arrangement is disposed adjacent to the woven material which moves traversely between a light source and at least three unit weft thread detectors. Each detector comprises an alignment slit and a transducer, and is designed so that a moire (generated by light passing through the divided slit arrangement and the weft threads of the woven material), as transmitted through a condensing lens and the alignment slit to the transducer, is converted to an electric signal. The alignment slits are arranged in correspondence to the preset angles of inclination of the respective unit slits which are deviated, for each detector, by suitable angles from the direction of the weft threads in a normal woven material. The output signals of the unit weft thread detectors are electrically scanned to obtain respective output voltages proportional to the light incident on each detector. Then, the detector having the maximum voltage is selected so as to identify, by means of the preset angle of inclination corresponding to a given alignment slit, the angle of inclination of the weft threads.

9 Claims, 3 Drawing Figures

DISTORTED TEXTURE DETECTING METHOD

BACKGROUND OF THE INVENTION

While, in a normal woven material, the weft threads generally cross the warp threads at an angle of 90 degrees, this relation tends to be frequently destroyed in the course of dying, treatment, and finishing of the woven material, and causes a distorted texture such as bending or slanting of the weft threads. This gives rise to such problems as a distortion in the dyed pattern or failure to hold the shape after sewing. In the past, it has been impossible to completely eliminate the occurrence of such distorted texture in spite of many different measures which have heretofore been proposed for this purpose. As a result, a variety of methods has been used to detect the bending of the weft threads in a woven material having a distorted texture and to correct the distorted texture mechanically.

Previously known methods for detecting the distorted texture of woven material are typically designed so that an image of the weft threads formed by the light transmitted through the woven material is detected.

A first known method comprises collimating the light from a light source with a projector lens and passing it through a moving woven material. The light is detected in a photoelectric transducer located behind a rectangular slit which is mechanically scanned and arranged so that the slit major axis extends substantially parallel to the weft threads of the woven material. Thus, a change in the intensity of the light incident on a photoelectric transducer is converted into an electric signal, is then amplified, and is shaped to generate a voltage proportional to the amplitude of the alternating voltage. The output voltage assumes a maximum value when the major axis direction of the slit aligns with the direction of the weft threads of the woven material. In other words, the direction of the slit which corresponds to the maximum output voltage represents the direction of the weft threads. As a result, if the slit is scanned mechanically over a suitable range of angles centering about an angle of 90 degrees with respect to the warp threads of the moving woven material, the slit angle at which the maximum output voltage for the scanning is produced will indicate the angle of the weft threads, thus making it possible to detect the presence of any distorted texture.

A second known method employs two units of the above-mentioned thread angle detector comprising a light source, a projector lens, a condensing lens, a slit and a photoelectric transducer. The detectors are symmetrically arranged side by side and at some angle with respect to the direction perpendicular to the warp threads of the woven material. Thus, since the difference between two output voltages is zero when the weft threads are perpendicular to the warp threads, when the voltage difference assumes a positive or negative value, variation in the angle of the weft threads is indicated.

While neither of these methods presents a problem in the case of a textile weave in which the image of the weft threads is relatively uncomplicated, they are disadvantageous in the case of a twill weave or satin weave because the image of the weft threads is difficult to distinguish. In such circumstances, a sufficient output voltage cannot be generated and, even if sufficient output voltage were obtained, it would (practically speaking) have no correlation with the direction of the weft threads, and this would make it impossible or difficult to detect the presence of a distorted texture. Another disadvantage of the first method is that, since the slit is scanned mechanically, it is impossible to increase the scanning speed. This results in a slow detection speed and a deteriorated response, thus making it disadvantageous to use the arrangement as a detecting means for an automatic distorted texture correcting apparatus.

The second method is also disadvantageous in that, even in the case of a plain weave in which detection is considered relatively easy, the proper detecting action cannot be ensured where there is a large difference between the preset angle of the slit and the angle of the weft threads, that is, when there exists a very large texture distortion.

SUMMARY OF THE INVENTION

The present invention has been created to overcome the foregoing deficiencies in the prior art. The invention comprises a distorted texture detection method in which there are provided at least three unit weft thread detectors, each comprising an alignment slit and a photoelectric transducer. A divided slit arrangement is disposed adjacent to a woven material moving traversely between a light source and the alignment slits. The divided slit arrangement includes a plurality of unit slits with a pitch substantially equal to that of the weft threads in the woven material, and is disposed in such a manner that its major axis direction is parallel to the major axis direction of the alignment slits. A moire generated by the divided slit arrangements and the weft threads of the woven material is concentrated by a condensing lens onto a photodetector array after passing through an array of alignment slits. The angle of inclination of the weft threads is detected by scanning each of the detectors, and by selecting that detector which achieves the maximum voltage (proportional to light incident thereon). The angle of inclination of the weft threads equals the preset angle of inclination of the particular selected photoelectric transducer which attains the maximum value of output voltage. More specifically, the detectors and corresponding associated unit slits are arranged in symmetrical fashion, each unit slit having an angle of inclination varying with respect to an angle of 90 degrees formed by the weft threads and the warp threads of a normal woven material. The preset angle of inclination of each slit differs from that of the adjacent slits by a predetermined angle. The output voltages of the unit weft thread detectors are electrically scanned, and that unit weft thread detector which generates the maximum value output voltage during the scanning is selected. Selection of a particular detector indicates a preset angle of inclination of a corresponding slit, which preset angle indicates the angle of inclination of the weft threads. The procedure is continuously carried out by repeating the scanning.

Therefore, it is an object of the present invention to provide a distorted texture detecting method capable of positively detecting a distorted texture in woven materials of all types of textile weaves.

It is another object of the invention to provide a distorted texture detecting method capable of detecting a distorted texture with a rapid response and greater accuracy.

It is another object of the invention to provide a distorted texture detecting method capable of satisfactorily detecting a distorted texture irrespective of the magnitude of distortion.

Other objects, features and advantages of the invention will appear more apparent from the following detailed description taken in conjunction with the accompany drawings.

DESCRIPTION OF THE PREFERRED EMBODIMENT

Figure 1:
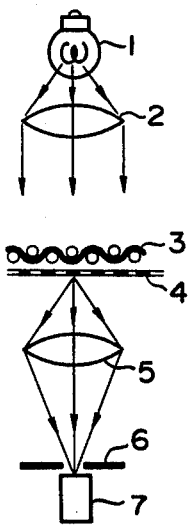
FIG. 1 is a schematic diagram showing one form of a unit weft thread detector used with the present invention.

Referring now to FIG. 1, which shows one form of a unit weft thread detector used with the invention, the light emitted from an incandescent lamp 1 is converted into parallel light rays by a projector lens 2, and the parallel light rays are projected through a moving woven material 3. Numeral 4 designates a divided slit arrangement (an optical diffraction grating) for generating, with the weft threads, an optical intereference fringe or moire, the arrangement 4 being disposed just below the woven material 3 so as to extend substantially parallel to the weft threads thereof, and including a large number of unit slits arranged in the same plane so as to run parallel with fixed pitches which correspond to the density of the weft threads in the woven material 3. Numeral 5 designates a condensing lens for focussing a moire generated by the woven material 3 and the divided slit arrangement 4 through an alignment slit 6 onto a detector 7. The alignment slit 6 is disposed so that its major axis extends perfectly parallel to the slit axis of the divided slit arrangement 4. Numeral 7 designates a photoelectric transducer of a known type disposed just below the alignment slit 6 to convert the light transmitted through the slit 6 into an electric signal generated thereby.

It is known in the art that, when the divided slit arrangement slit 4 is disposed adjacent to and substantially parallel to the weft threads of the woven material 3, if the pitch of the weft threads of the woven material 3 is substantially the same as that of the unit slits of the divided slit arrangement 4, an optical interference fringe or moire will be generated, and the angle of inclination of the moire with respect to the divided slit arrangement 4 will be zero if the divided slit arrangement 4 is arranged so that it is completely parallel to the weft threads.

If the above-mentioned principles are used in the apparatus of FIG. 1, the moire produced by the moving woven material 3 and the divided slit arrangement 4 will move in the warp direction in the same manner as the weft threads, so that the light transmitted through the alignment slit 6 will result in a beam of light containing an alternating component, the period of which is the time required for the woven material 3 to move a distance corresponding to one weft thread, the amplitude of the alternating component attaining the maximum value when the weft threads are parallel to the divided slit arrangement 4. Thus, there will be seen a change in the intensity or change in the velocity of the incident light passing through the alignment slit 6, which intensity of light is converted into an electric signal by the photoelectric transducer 7 disposed just below the slit 6, the photoelectric transducer 7 comprising a photoconductive element such as a phototransistor. The signal is then further subjected to signal processing, including waveform shaping, amplification, rectification, etc., thus generating a voltage proportional to the amplitude of the oscillatory component of the incident light intensity. The angle of inclination of that unit slit, in the divided slit arrangement 4, corresponding to the maximum value output of the photo-electric transducer 7 will then indicate the angle of inclination of the weft threads. In other words, by using this type of unit weft thread detector, it is possible to detect that the weft threads are parallel to the divided slit arrangement 4.

Figure 2:
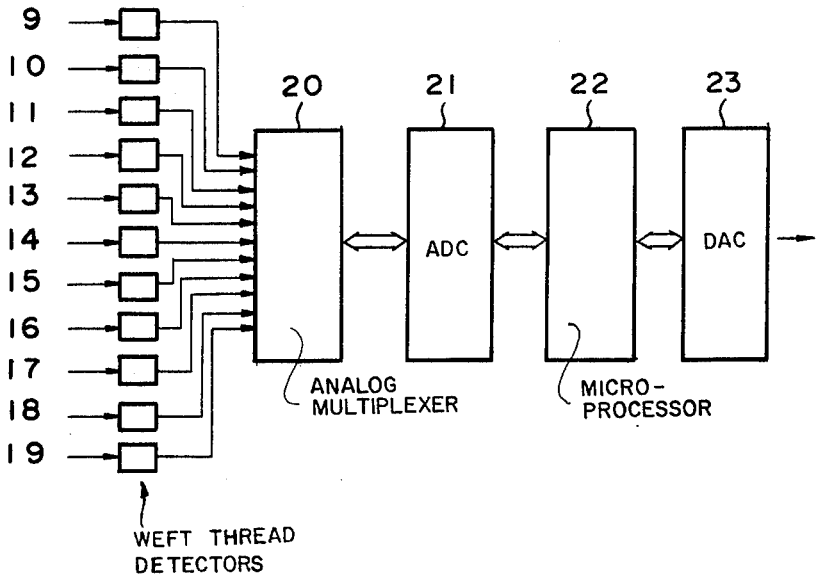
FIG. 2 is a block diagram useful for explaining a distorted texture detecting method according to the invention.

FIG. 2 is a block diagram useful for explaining the method of this invention which is designed to detect a distorted texture by using unit weft thread detectors of the above-mentioned construction and principles. In the Figure, numerals 9 to 19 designate eleven unit weft thread detectors arranged so that the respective angles of inclination of each corresponding unit slit in the divided slit arrangement 4 differs respectively from adjacent ones by a predetermined angle of, for example, 3° centered around the angle of inclination of 90 degrees formed by the weft and warp threads of a normal woven material. In other words, the angle of inclination for the unit slit is selected to be 105° for the unit weft thread detector 9, 102° for the detector 10, 99° for the detector 11, 96° for the detector 12, 93° for the detector 13, 90° for the detector 14, 87° for the detector 15, 84° for the detector 16, 81° for the detector 17, 78° for the detector 18, and 75° for the detector 19.

Figure 3:
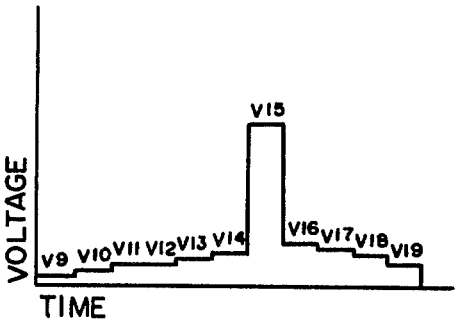
FIG. 3 is a graph showing an example of an output waveform generated by one scanning in accordance with the method of the invention.

Numeral 20 designates a known type of analog multiplexer which is controlled by a known type of microprocessor 22 to electrically scan the output voltages of the unit weft thread detectors 9 to 19 at the rate of 100 times per second (for example), and to apply its output voltage to a known type of analog-to-digital converter 21. The output voltage applied to the analog-to-digital converter 21 is converted to a digital signal which, in turn, is subjected to computational operations in the microprocessor 22 so as to select that unit weft thread detector which generated the maximum output voltage. FIG. 3 shows by way of example the relationship between the voltage and the time during one scanning of the analog multiplexer 20, $V_9$ to $V_{19}$ respectively corresponding to the output voltages of the unit weft thread detectors 9 to 19. In other words, FIG. 3 shows that the maximum output votage is $V_{15}$ corresponding to the unit weft thread detector 15, and consequently the angle of inclination of the weft threads is equal to the preset angle of inclination of 87° of the thus selected unit weft thread detector 15. Thus, by generating an analog voltage proportional to the angle of inclination of the weft threads through a known type of digital-to-analog coverter 23, it is possible to detect a distorted texture.

The size and shape of the divided slit arrangement 4 used with the invention may be suitably selected in dependence on the weave of a woven material subjected to detection, and it is important to select the pitch of the divided slit arrangement 4 substantially equal to the pitch of the weft threads. Of course, the number of lines per unit length of the divided slit arrangement 4 may be varied within about ±20% of the weft thread pitch. The divided slit arrangement 4 used with the invention may be easily produced by, for example, ruling grooves of 0 to 0.2 mm in depth on the surface of a glass plate to produce 10 to 20 slits having a pitch of 0.15 to 1.0 mm and a slit major axis length of 10 to 30 mm, and introducing black paint into the grooves.

The shape and size of the image forming slit 6 should preferably be selected in dependence on the magnitude of moires to be formed thereon, and a slit having a rectangular aperture of 1 mm×5 mm, for example, may be used.

The number of unit weft thread detectors used may be suitably selected in consideration of detection accuracy, cost, etc., and it is important to use at least three units of the detector.

While, in the above-mentioned embodiment, the divided slit arrangement 4 is disposed below the woven material, it is of course possible to mount it in a position above the woven material.

It will thus be seen from the foregoing that, by virtue of the fact that the required output voltage for detecting the direction of the weft threads is obtained by utilizing the moire produced by the moving woven material and the divided slit arrangement, the present invention has very great utility value as a distorted texture detecting method having general purpose properties or versatility, in that the production of sufficient output voltages necessary for detecting purposes in relation to the direction of the weft threads is ensured not only in the case of plain weave but also in the case of other textile weaves, such as twill weave, satin weave, etc. Further, while even a slight deviation of the parallel relationship between the weft threads and the divided slit arrangement results in a sharp decrease in the output voltage of the unit weft thread detector due to a kind of amplifying action, in that the angle of inclination of a moire assumes a value which is much greater than the angle formed by the divided slit and the weft threads, this provides an excellent ability to separate the angles of inclination of the weft threads; that is, where a plurality of unit weft thread detectors are used, as in the case of the invention, the difference in the sensitivity of the detectors practically has no effect, and as a result the distorted texture detecting method of this invention is very excellent in its overall accuracy. In this connection, the actual measurements made with the method of this invention have shown that, as regards the ratio between $V_{15}$ and $V_{14}$ or $V_{15}$ and $V_{16}$ in FIG. 3, a ratio of over 10:1 is ensured in the case of a plain weave which is relatively easy to detect, and a ratio of 3:1 is ensured in the case of a satin weave which is difficult to detect. Further, by suitably increasing the number of unit weft thread detectors used, it is possible to increase the range of detectable angles of inclination of distorted texture, and it also possible to improve greatly, with respect to the prior art methods, the response of the distorted texture detecting method utilizing the electrical scanning and microprocessor. Further, by virtue of the fact that the method of the invention is capable of detecting the direction as well as the magnitude of a distorted texture, the invention is extremely useful as a distorted texture detecting method for an automatic distorted texture correcting apparatus.

We claim:

1. A method for detecting distorted texture in weft threads of a woven material moving traversely between a light source and an alignment slit, comprising the steps of:

providing a divided slit arrangement including a plurality of unit slits;

providing each unit slit with a respective preset angle of inclination which differs by a predetermined angle from the preset angle of inclination of adjacent said unit slits;

generating a moire by moving said weft threads of said woven material adjacent to said divided slit arrangement and illuminating said woven material and said divided slit arrangement;

detecting and transducing said moire through said alignment slit to develop a plurality of voltages, each voltage being proportional to light incident on a respective one of said unit slits;

scanning said plurality of voltages to determine said voltage having the greatest magnitude; and selecting said respective one of said unit slits corresponding to said voltage having the greatest magnitude so as to determine the preset angle of inclination of said selected respective one of said unit slits, whereby to detect the direction of the weft threads in said woven material.

2. The method of claim 1, wherein said plurality of unit slits has a pitch substantially equal to that of the weft threads in said woven material.

3. The method of claim 1, wherein said alignment slit has a major axis direction, and wherein said divided slit arrangement has a major axis direction corresponding to said major axis direction of said alignment slit.

4. The method of claim 1, comprising the additional step, between said generating step and said detecting and transducing step, of using a condensing lens to concentrate the radiation of said moire.

5. The method of claim 1, wherein said detecting and transducing step is performed by at least three unit weft thread detectors.

6. The method of claim 1, wherein said scanning step is performed by an analog multiplexer.

7. The method of claim 1, wherein said selecting step is performed by a microprocessor.

8. The method of claim 1, comprising the additional step, after said scanning step, of converting said plurality of voltages from analog to digital form.

9. The method of claim 8, whrein said selecting step is performed by a microprocessor.

* * * * *